United States Patent [19]

Reeves

[11] Patent Number: 4,714,163

[45] Date of Patent: Dec. 22, 1987

[54] STACKABLE SHIPPING EDGE PROTECTOR

[75] Inventor: Robert E. Reeves, Indianapolis, Ind.

[73] Assignee: Pakway Container Corp., Indianapolis, Ind.

[21] Appl. No.: 11,295

[22] Filed: Feb. 5, 1987

[51] Int. Cl.[4] ..... A47B 95/00; B65D 81/02

[52] U.S. Cl. ..... 206/518; 206/320; 206/521; 206/586; 229/DIG. 1; 248/345.1

[58] Field of Search ..... 206/320, 453, 518, 520, 206/521, 586; 217/36, 52, 53; 229/DIG. 1; 248/345.1

[56] References Cited

U.S. PATENT DOCUMENTS

| | | | |
|---|---|---|---|
| 2,995,863 | 8/1961 | Bright | 248/345.1 |
| 3,314,584 | 4/1967 | Knapp et al. | 206/586 |
| 3,356,209 | 12/1967 | Pezely, Jr. | 206/586 |
| 3,580,469 | 5/1971 | Reese | 206/586 |
| 3,836,043 | 9/1974 | Levin | 206/586 |
| 3,960,354 | 6/1976 | Simikoski | 229/DIG. 1 |

FOREIGN PATENT DOCUMENTS

| | | | |
|---|---|---|---|
| 2112856 | 9/1972 | Fed. Rep. of Germany | 206/521 |

*Primary Examiner*—Jimmy G. Foster

*Attorney, Agent, or Firm*—Woodard, Emhardt, Naughton Moriarty & McNett

[57] ABSTRACT

A stackable edge protector for use in packaging. A multi-ply fibreboard construction having a right angle cross-section with sufficient length to extend along the edge of the product to be protected. Adhesive pads facing inwardly on the construction removably secure the edge protector to the product. Outwardly opening recesses located on the outer surface of the main body nestably receive the adhesive pads of an identical edge protector when stacked thereatop. The recesses are larger in size than the adhesive pads preventing stacked edge protectors from adhering together.

13 Claims, 4 Drawing Figures

STACKABLE SHIPPING EDGE PROTECTOR

BACKGROUND OF THE INVENTION

This invention is in the field of protective shipping devices utilized with a variety of shippable products. The traditional method of shipping a product such as a stove or other such large product involves packing the product within a fibreboard box having fibreboard inserts positioning and holding the product within the box. Alternatively, the product may be wrapped in a heat shrinkable plastic sheet with fibreboard inserts being utilized between the product and plastic sheet.

The corner edges of a product may become damaged during storage and shipment, particularly when the product is not contained within a fibreboard box. Thus, it is desirable to place edge protectors on each edge of the product when the heat shrink plastic method of packaging is utilized. The edge protector must be self-adhering to facilitate the packaging process. Likewise, the edge protectors must be stackable for storage purposes prior to use. In the event self-adhering adhesive is applied to the edge protector, then the adhesive must be initially covered with a wrapping such as release paper to prevent the edge protectors from adhering together when stacked prior to usage. The release paper must therefore be removed and discarded for each protector adding to the packaging cost and providing clutter. Disclosed herein is a self-adhering corner protector with exposed adhesive thereon which is nestable within recesses of adjacent edge protectors allowing the protectors to be stacked without adhering together.

SUMMARY OF THE INVENTION

One embodiment of the present invention is a stackable shipping edge protector comprising a main body having a right angle shaped cross section extending substantially the length thereof and forming a pair of inwardly facing surfaces and a pair of outwardly facing surfaces, and, pressure sensitive adhesive means provided on the pair of inwardly facing surfaces and having a first length and a first width being operable to removably secure the main body to a corner edge of a product to protect same during shipment thereof, and wherein the main body includes a recessed portion on the pair of outwardly facing surfaces aligned with the adhesive means located on the pair of inwardly facing surfaces, the recessed portion of a size greater than the adhesive means to nestably receive the adhesive means on an identical shipping edge protector stacked thereatop without adhesively securing stacked edge protectors together.

Another embodiment of the present invention is a shipping device for a product comprising a plurality of stackable shipping edge protectors each including a main body having a right angle shaped cross section extending substantially the length thereof and forming a pair of inwardly facing surfaces and a pair of outwardly facing surfaces, and further including pressure sensitive adhesive means provided on the pair of inwardly facing surfaces and having a first length and a first width being operable to removably secure the main body to a corner edge of a product to protect same during shipment thereof. the main body including a removed portion on the pair of outwardly facing surfaces aligned with the adhesive means located on the pair of inwardly facing surfaces, the removed portion having a second length and a second width greater than respectively the first length and the first width to nestably receive the adhesive means on an identical shipping edge protector stacked thereatop without adhesively securing stacked edge protectors together, and, packing means surrounding the edge protectors when the edge protectors are positioned on corner edges of a product to be shipped.

It is an object of the present invention to provide a stackable edge protector with exposed self-adhering adhesive.

A further object of the present invention is to provide a new and improved shipping device for a product.

In addition, it is an object of the present invention to provide a stackable self-adhering shipping post which may be utilized with heat shrinkable plastic sheet for packaging pruposes.

Related objects and advantages of the present invention will be apparent from the following description.

DESCRIPTION OF THE PREFERRED EMBODIMENT

Figure 1:
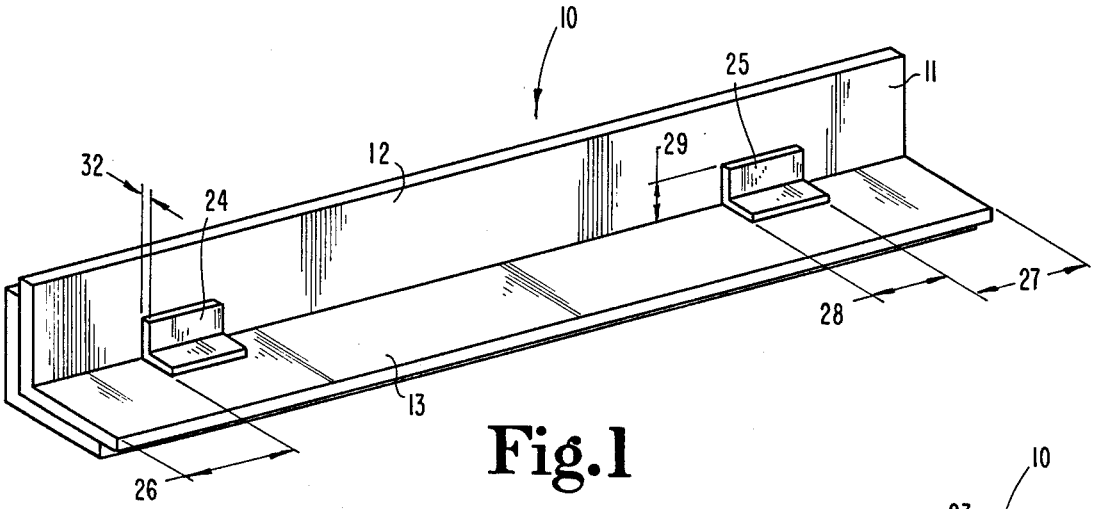
FIG. 1 is a bottom perspective view of an edge protector incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
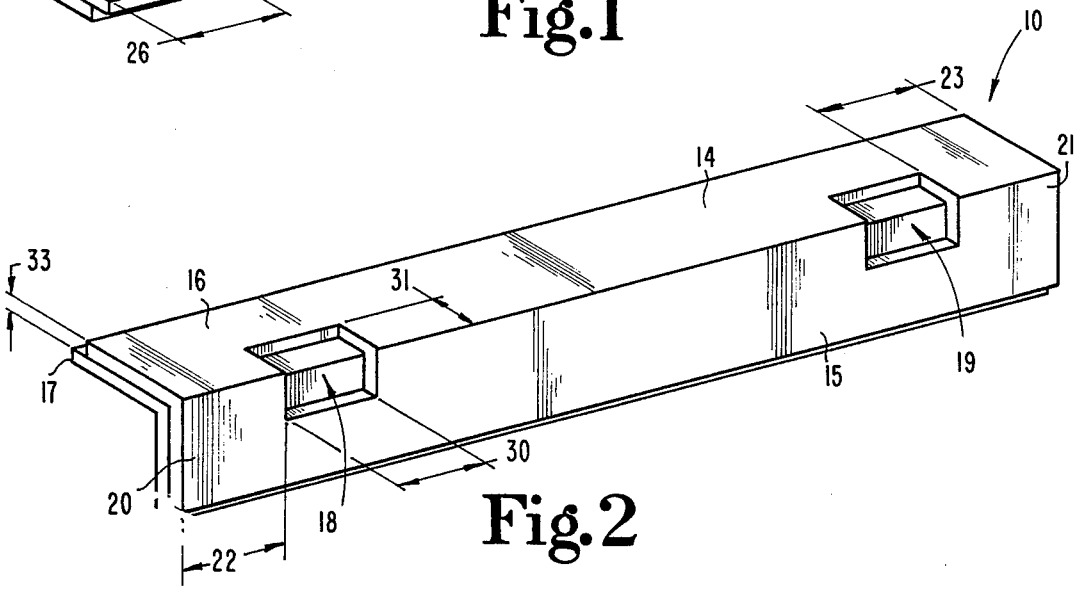
FIG. 2 is a top perspective view of the edge protector of FIG. 1.

Referring now more particularly to the FIGS. 1 and 2, there is shown a stackable edge protector 10 incorporating the present invention. Edge protector 10 includes a main body 11 having a right angle or L-shaped cross-section extending substantially the length thereof. Main body 11 has a pair of inwardly facing surfaces 12 and 13 and a pair of outwardly facing surfaces 14 and 15. Main body 11 may be produced from a multi-ply fibreboard construction and in the embodiment shown in the drawing has an outer sheet 16 and an identically sized inner sheet 17 fixedly secured together by glue. Outer sheet 16 has a pair of openings 18 and 19 which are located respectively equidistant from the opposite ends 20 and 21 of the main body. That is, distance 22 from the edge of end 20 to the end of opening 18 is the same ad distance 23 which is from the edge of end 21 to the edge of opening 19. Each opening 18 and 19 is of a right angle configuration in that each opening extends equidistant across the width of surfaces 14 and 15. Inner sheet 17 extends entirely interiorally across openings 18 and 19 forming a pair of recesses which open outwardly in the main body.

Figure 3:
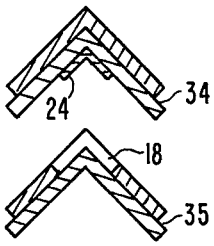
FIG. 3 is a cross-sectional view showing two edge protectors to be stacked together.
Figure 4:
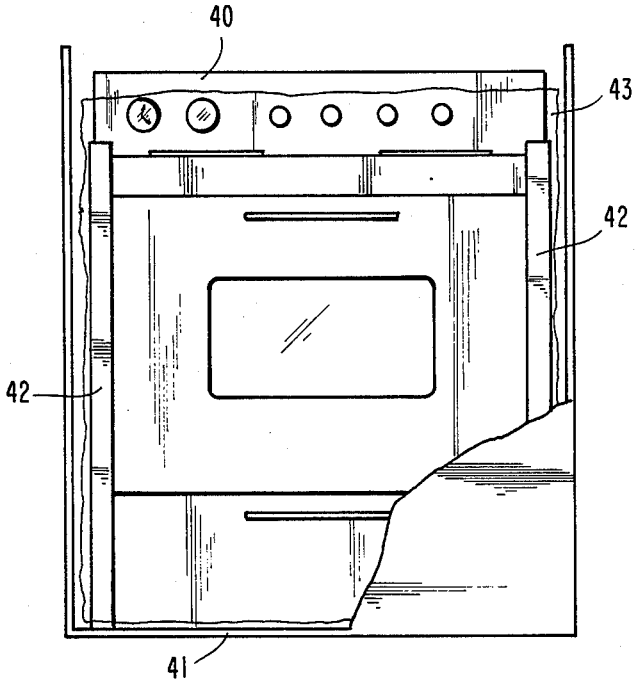
FIG. 4 is a fragmentary view of a shipping container having a product stored therein with the edge protector of FIG. 1.

A pair of adhesive pads 24 and 25 are fixedly secured to surfaces 12 and 13 and face inwardly. Adhesive pads 24 and 25 have a right angle configuration and extend equidistant across the width of surfaces 12 and 13. Likewise, the pads are located equidistant fromt he opposite end of main body 11. That is, pad 24 is located a distance 26 from end 20 of main body 11 whereas pad 25 is located a distance 27 from end 21 of the main body with distances 26 and 27 being equal. Adhesive pads 24 and 25 have a size smaller than the size of openings 18 and 19 to allow the pads to be nestably received within the openings when stacked such as shown in FIG. 3. Thus, while distances 22 and 23 are equal, distance 26 is slightly greater than distance 22 to allow the adhesive pad to be freely received within the opening. The length 28 of each pad 24 and 25 is less than the length 30 of each opening 18 and 19, whereas the width 29 of each leg of pad 24 and pad 25 is less than the width 31 of each leg of opening 18 and 19. Most importantly, the thickness 32 of each pad 24 and 25 is less than the thickness 33 of outer sheet 16. Thus, when two identical edge protectors 34 and 35 (FIG. 3) are stacked together, the adhesive pads 24 and 25 are nestably received within openings 18 and 19 without the adhesive means contacting either the edges defining openings 18 or 19, or the inner sheet 17 which extends across each opening. It is therefore unnecessary to use a release paper to cover the adhesive pads prior to usage. The edge protectors may therefore be stacked prior to usage without the edge protectors adhering together.

The pressure sensitive adhesive pads 24 and 25 are operable to removably secure the edge protector to a corner edge of a product to protect same during shipment thereof. For example, a product such as a stove 40 is shown positioned within a fibreboard box 41 with a plurality of edge protectors 42 being removably secured to each corner edge of the stove. In addition, a heat shrinkable plastic sheet 43 may be utilized to surround the stove having the edge protectors secured thereto. In certain cases, adequate packaging is provided through the utilization of the heat shrinkable plastic with the edge protectors without the outer firbreboard box being utilized.

Many variations are contemplated and included in the present invention. For example, in lieu of utilizing a multi-ply fibreboard construction for the edge protector, the main body of the procector may be produced from a pair of right angle configured plastic members heat sealed together with the recess formed in the outer sheet and the adhesive means secured to the inner sheet in the manner previously disclosed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A stackable shipping edge protector comprising:

a main body having a right angle shaped cross section extending substantially the length thereof and forming a pair of inwardly facing surfaces and a pair of outwardly facing surfaces; and, pressure sensitive adhesive means provided on said pair of inwardly facing surfaces and having a first length and a first width being operable to removably secure said main body to a corner edge of a product to protect same during shipment thereof; and wherein:

said main body includes a recessed portion on said pair of outwardly facing surfaces aligned with said adhesive means located on said pair of inwardly facing surfaces, said recessed portion of a size greater than said adhesive means to nestably receive said adhesive means on an identical shipping edge protector stacked thereatop without adhesively securing stacked edge protectors together.

2. The shipping edge proector of claim 1 wherein:

said main body is of a multi-ply construction and has an outer sheet and an inner sheet fixedly secured together, said outer sheet has an opening extending therethrough forming said recessed portion which has a second length and a second width greater than respectively said first length and said first width, said adhesive means is secured to said inner sheet adjacent said opening.

3. The shipping edge protector of claim 2 wherein:

said main body includes at least two fibreboard sheets fixedly secured together.

4. A shipping device for a product comprising:

a plurality of stackable shipping edge protectors each including a main body having a right angle shaped cross section extending substantially the length thereof and forming a pair of inwardly facing surfaces and a pair of outwardly facing surfaces, and further including pressure sensitive adhesive means provided on said pair of inwardly facing surfaces and having a first length and a first width being operable to removably secure said main body to a corner edge of a product to protect same during shipment thereof, said main body including a removed portion on said pair of outwardly facing surfaces aligned with said adhesive means located on said pair of inwardly facing surfaces, said removed portion having a second length and a second width greater than respectively said first length and said first width to nestably receive said adhesive means on an identical shipping edge protector stacked thereatop without adhesively securing stacked edge protectors together; and, packing means surrounding said edge protectors when said edge protectors are positioned on corner edges of a product to be shipped.

5. The shipping device of claim 4 wherein:

said packing means is a box holding said plurality of edge protectors secured to a product to be shipped.

6. The shipping device of claim 4 wherein:

said plurality of edge protectors are secured to a product to be shipped and said packing means includes a thin plastic sheet wrapped around said edge protectors and said product.

7. The shipping device of claim 4 wherein:

said main body is of a multi-ply construction and has an outer sheet and an inner sheet fixedly secured together, said outer sheet has an opening extending therethrough forming said removed portion, said adhesive means is secured to said inner sheet adjacent said opening.

8. The shipping edge protector of claim 7 wherein:

said main body includes at least two fibreboard sheets fixedly secured together.

9. A stackable shipping edge protector comprising:

a multi-ply fibreboard main body having an L shaped cross section extending substantially the length thereof, said main body having an outer sheet and an inner sheet fixedly secured together, said outer sheet including a pair of openings extending therethrough with said inner sheet extending longitudinally with said outer sheet and extending over each of said pair of openings forming a pair of recesses in said main body opening outwardly; and, a pair of exposed adhesive means to removably secure said main body to an external object, said adhesive means fixedly secured to said inner sheet to face inwardly being located adjacent said pair of recesses to be nestably received in a pair of recesses of an adjacent identical edge protector when stacked thereatop.

10. The edge protector of claim 9 wherein:

said edge protector is grouped with a plurality of identical edge protectors removably secured to corners of a product to protect same during shipment thereof, and further with packing means surrounding said edge protectors.

11. The shipping device of claim 10 wherein:

said packing means includes a box holding said plurality of edge protectors secured to a product to be shipped.

12. The shipping device of claim 10 wherein:

said plurality of edge protectors are secured to said product to be shipped and said packing means includes a thin plastic sheet wrapped around said edge protectors and said product.

13. The shipping device of claim 10 wherein:

said main body has opposite ends with said said pair of exposed adhesive means located respectively equidistant from said opposite ends.

* * * * *